US010906760B2

(12) United States Patent
Tateishi

(10) Patent No.: US 10,906,760 B2
(45) Date of Patent: Feb. 2, 2021

(54) SHEET FEEDING APPARATUS AND IMAGE FORMING APPARATUS

(71) Applicant: CANON KABUSHIKI KAISHA, Tokyo (JP)

(72) Inventor: Satohisa Tateishi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/166,430

(22) Filed: Oct. 22, 2018

(65) Prior Publication Data

US 2019/0144219 A1 May 16, 2019

(30) Foreign Application Priority Data

Nov. 15, 2017 (JP) ..... 2017-220443

(51) Int. Cl.
*B65H 3/06* (2006.01)
*B65H 1/14* (2006.01)
(Continued)

(52) U.S. Cl.
CPC ..... *B65H 3/0669* (2013.01); *B65H 1/14* (2013.01); *B65H 3/06* (2013.01); *B65H 3/0684* (2013.01);
(Continued)

(58) Field of Classification Search
CPC ..... B65H 3/0669; B65H 3/0684; B65H 3/46; B65H 3/5246; B65H 3/5261; B65H 2403/72; B65H 2511/524; B65H 2513/10
See application file for complete search history.

(56) References Cited

U.S. PATENT DOCUMENTS 5,868,385 A 2/1999 Embry et al.
6,227,534 B1 * 5/2001 Schoedinger ..... B65H 3/0669 271/110
(Continued)

FOREIGN PATENT DOCUMENTS

CN 1193573 A 9/1998
CN 1313199 A 9/2001
(Continued)

OTHER PUBLICATIONS

Chinese Office Action dated Jun. 3, 2020, in related Chinese Patent Application No. 201811349295.8 (with English translation).

*Primary Examiner* — Prasad V Gokhale
(74) *Attorney, Agent, or Firm* — Venable LLP

(57) ABSTRACT

A sheet feeding apparatus includes a sheet stacking portion on which a sheet is stacked, and a one-way clutch configured such that (i) in delivering the sheet stacked on the sheet stacking portion toward a separation nip, rotation of a drive shaft in a first rotational direction is transmitted through the one-way clutch, a drive gear and a gear train rotate a pick-up roller without slipping of the one-way clutch, and (ii) after a leading edge of the sheet has reached the separation nip, the pick-up roller is dragged and rotated by the sheet conveyed by a feed roller, rotation of the pick-up roller is transmitted through the gear train to the drive gear, and the drive gear is rotated in the first rotational direction with respect to the drive shaft that is rotated in the first rotational direction while the one-way clutch is slipping.

7 Claims, 7 Drawing Sheets

(51) Int. Cl.

| | |
|---|---|
| ***B65H 3/54*** | (2006.01) |
| ***B65H 3/52*** | (2006.01) |
| *B65H 7/14* | (2006.01) |
| *B41J 13/10* | (2006.01) |
| *B41J 13/03* | (2006.01) |

(52) U.S. Cl.
CPC ..... *B65H 3/5261* (2013.01); *B65H 3/54* (2013.01); *B41J 13/03* (2013.01); *B41J 13/103* (2013.01); *B65H 7/14* (2013.01); *B65H 2403/72* (2013.01); *B65H 2511/52* (2013.01); *B65H 2511/524* (2013.01); *B65H 2513/10* (2013.01); *B65H 2801/06* (2013.01)

(56) References Cited

U.S. PATENT DOCUMENTS

| | | | | |
|---|---|---|---|---|
| 6,293,539 | B1 | 9/2001 | Fukatsu et al. | |
| 6,502,816 | B2 | 1/2003 | Inoue et al. | |
| 7,093,830 | B2 * | 8/2006 | Kang | B41J 13/103 271/117 |
| 7,121,546 | B2 | 10/2006 | Johnson et al. | |
| 7,258,335 | B2 * | 8/2007 | Johnson | B41J 11/009 271/10.01 |
| 8,201,817 | B1 * | 6/2012 | Boo | B65H 3/0669 271/10.13 |
| 9,272,861 | B2 | 3/2016 | Tateishi et al. | |
| 9,272,862 | B2 | 3/2016 | Tateishi | |
| 10,059,540 | B2 | 8/2018 | Tateishi | |
| 2008/0265490 | A1 * | 10/2008 | Hendrix | B65H 3/0684 271/117 |
| 2011/0024969 | A1 * | 2/2011 | Matsushima | B65H 3/0669 271/10.11 |

FOREIGN PATENT DOCUMENTS

| | | | |
|---|---|---|---|
| CN | 106183468 | A | 12/2016 |
| JP | H06-144609 | A | 5/1994 |
| JP | H10-167495 | A | 6/1998 |
| JP | 2001-287841 | A | 10/2001 |
| JP | 2002-145467 | A | 5/2002 |
| JP | 2002-167062 | A | 6/2002 |
| JP | 3840099 | B2 | 11/2006 |
| JP | 2009-107831 | A | 5/2009 |
| JP | 2009-274865 | A | 11/2009 |
| JP | 2014-007036 | A | 1/2014 |
| JP | 2016-041613 | A | 3/2016 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus including the sheet feeding apparatus.

Description of the Related Art

Sheet feeding apparatuses used in products, such as printers, copying machines, and multifunction printers, feed sheets stacked on a sheet stacking portion, such as a cassette or a tray, while separating the sheets one by one. Such a sheet feeding apparatus has a known configuration including a pickup roller which feeds an uppermost sheet from the sheet stacking portion, a feed roller which receives the sheet from the pickup roller and conveys the sheet, and a separation roller which faces the feed roller. The separation roller separates the sheet, to be conveyed by the feed roller, from another sheet that otherwise passes through a nip portion formed between the feed roller and the separation roller, by applying frictional force to the other sheet.

For such a configuration, there is a known technique which changes, in the feeding process, a contact pressure of the roller member which feeds sheets from the sheet stacking portion. The contact pressure is a pressure applied from the roller member to the sheets. Japanese Patent Application Publication No. H06-144609 describes a configuration in which a nudger roller used to feed sheets from a sheet feeding tray is supported by a support link. The support link swings on a support shaft disposed upstream from the nudger roller in a sheet feeding direction. In this configuration, when feeding sheets, the nudger roller receives a reaction force from the sheets. The reaction force produces a moment which causes the support link to swing downward, and the moment increases contact pressure of the nudger roller to the sheets.

In addition, Japanese Patent Application Publication No. 2016-41613 describes a configuration in which a sheet feeding roller which feeds sheets from a cassette is supported by a swing member, and driven by a driving gear. The swing member swings on a fulcrum positioned upstream from the sheet feeding roller in a sheet feeding direction, and the driving gear is disposed on a swing axis of the swing member. On the same axis as that of the sheet feeding roller, a clutch mechanism is disposed, and the conveyance speed by the sheet feeding roller is smaller than that by a conveyance roller disposed downstream from the sheet feeding roller. In this configuration, before the leading edge of a sheet reaches the conveyance roller, the contact pressure of the sheet feeding roller is increased by the driving force of the driving gear; and after the leading edge of the sheet has already reached the conveyance roller, the contact pressure of the sheet feeding roller is decreased because the clutch mechanism slips due to an increased moving speed of the sheet.

Here, it is preferable that the contact pressure of the pickup roller to the sheets is high when the pickup roller feeds a sheet from the sheet stacking portion, and is low when the sheet is separated by the feed roller and the separation roller. This is because the high contact pressure allows the pickup roller to stably deliver sheets from the sheet stacking portion even when the sheets have high conveyance resistance, and because the low contact pressure allows a sheet stacked under an uppermost sheet to be less likely fed together with the uppermost sheet (multi-fed) when the uppermost sheet is to be separated.

In the configuration described in Japanese Patent Application Publication No. H06-144609, even though a sheet reaches a roller pair which is disposed downstream from the nudger roller to separate the sheet, the contact pressure of the nudger roller remains high, possibly causing multi-feeding of sheets. On the other hand, in the configuration described in Japanese Patent Application Publication No. 2016-41613, even though the contact pressure is reduced by a certain amount when the sheet feeding roller runs at idle, the contact pressure is required to be further reduced for ensuring conveyance capability for sheets while improving separation capability for the same.

SUMMARY OF THE INVENTION

The present invention provides a sheet feeding apparatus and an image forming apparatus reliably achieving both of increasing the conveyance capability and preventing the multi-feeding According to one aspect of the invention, a sheet feeding apparatus includes: a sheet stacking portion on which a sheet is stacked; a rotary pick-up member configured to rotate, in contact with a top surface of the sheet stacked on the sheet stacking portion, and deliver the sheet in a sheet feeding direction; a rotary feed member disposed downstream from the rotary pick-up member in the sheet feeding direction and configured to convey the sheet; a separation member disposed in contact with the rotary feed member and configured to separate the sheet conveyed by the rotary feed member from another sheet at a separation portion formed between the separation member and the rotary feed member; a holding member holding the rotary pick-up member rotatably and configured to swing on a swing axis positioned upstream from a rotation axis of the rotary pick-up member in the sheet feeding direction; a rotary driving member configured to rotate, being driven by a driving source, on the swing axis of the holding member; and a drive transmission portion supported by the holding member and capable of transmitting rotation from the rotary driving member to the rotary pick-up member and vice versa, the drive transmission portion being configured such that (i) in delivering the sheet stacked on the sheet stacking portion toward the separation portion, the drive transmission portion transmits rotation of the rotary driving member, performed in a first rotational direction, to the rotary pick-up member and rotates the rotary pick-up member, wherein the first rotational direction is a rotation direction that a downstream side of the rotary driving member with respect to the swing axis in the sheet feeding direction moves downward and an upstream side of the rotary driving member with respect to the swing axis moves upward, and (ii) in conveying the sheet by the rotary feed member after a leading edge of the sheet in the sheet feeding direction has reached the separation portion, the drive transmission portion transmits rotation of the rotary pick-up member rotated by the sheet to the rotary driving member and rotates the rotary driving member in the first rotational direction.

According to another aspect of the invention, a sheet feeding apparatus includes: a sheet stacking portion on which a sheet is stacked; a rotary pick-up member configured to rotate, in contact with a top surface of the sheet stacked on the sheet stacking portion, and deliver the sheet in a sheet feeding direction; a rotary feed member disposed downstream from the rotary pick-up member in the sheet feeding direction and configured to convey the sheet; a separation member disposed in contact with the rotary feed member and configured to separate the sheet conveyed by the rotary feed member from another sheet at a separation portion formed between the separation member and the rotary feed member; a holding member holding the rotary pick-up member rotatably and configured to swing on a swing axis positioned upstream from a rotation axis of the rotary pick-up member in the sheet feeding direction; a shaft member disposed on the swing axis and configured to be rotated by a driving source; a rotary driving member supported on the shaft member and configured to rotate on the swing axis; a drive transmission portion supported by the holding member and capable of transmitting rotation from the rotary driving member to the rotary pick-up member and vice versa, the drive transmission portion being configured to rotate the rotary pick-up member in a rotational direction along with the sheet feeding direction in a case where the rotary driving member rotates in a first rotational direction, the first rotational direction being a rotation direction that a downstream side of the rotary driving member with respect to the swing axis in the sheet feeding direction moves downward and an upstream side of the rotary driving member with respect to the swing axis moves upward; and a one-way clutch disposed between the shaft member and the rotary driving member and configured to transmit rotation of the shaft member in the first rotational direction to the rotary driving member and to allow the rotary driving member to rotate in the first rotational direction relative to the shaft member.

According to still another aspect of the invention, an image forming apparatus includes: a sheet feeding apparatus configured to feed a sheet; and an image forming portion configured to form an image on a sheet fed by the sheet feeding apparatus. The sheet feeding apparatus includes: a sheet stacking portion on which a sheet is stacked; a rotary pick-up member configured to rotate, in contact with a top surface of the sheet stacked on the sheet stacking portion, and deliver the sheet in a sheet feeding direction; a rotary feed member disposed downstream from the rotary pick-up member in the sheet feeding direction and configured to convey the sheet; a separation member disposed in contact with the rotary feed member and configured to separate the sheet conveyed by the rotary feed member from another sheet at a separation portion formed between the separation member and the rotary feed member; a holding member holding the rotary pick-up member rotatably and configured to swing on a swing axis positioned upstream from a rotation axis of the rotary pick-up member in the sheet feeding direction; a rotary driving member configured to rotate, being driven by a driving source, on the swing axis of the holding member; and a drive transmission portion supported by the holding member and capable of transmitting rotation from the rotary driving member to the rotary pick-up member and vice versa, the drive transmission portion being configured such that (i) in delivering the sheet stacked on the sheet stacking portion toward the separation portion, the drive transmission portion transmits rotation of the rotary driving member, performed in a first rotational direction, to the rotary pick-up member and rotates the rotary pick-up member, wherein the first rotational direction is a rotation direction that a downstream side of the rotary driving member with respect to the swing axis in the sheet feeding direction moves downward and an upstream side of the rotary driving member with respect to the swing axis moves upward, and (ii) in conveying the sheet by the rotary feed member after a leading edge of the sheet in the sheet feeding direction has reached the separation portion, the drive transmission portion transmits rotation of the rotary pick-up member rotated by the sheet to the rotary driving member and rotates the rotary driving member in the first rotational direction.

Further features of the present invention will become apparent from the following description of exemplary embodiments with reference to the attached drawings.

DESCRIPTION OF THE EMBODIMENTS

Hereinafter, a sheet feeding apparatus of the present disclosure and an image forming apparatus including the sheet feeding apparatus will be described with reference to the accompanying drawings. The sheet feeding apparatus is used as an apparatus to feed sheets, which are used as a record medium or a document in the image forming apparatus. The image forming apparatus may be a printer, a copying machine, a facsimile, or a multifunction printer; and forms images on sheets, depending on image information sent from an external PC or read from documents. The sheets used as a record medium may be pieces of paper, such as plain paper or thick paper, pieces of specialized paper such as coated paper, plastic films used for an overhead projector, or pieces of cloth.

Figure 1:
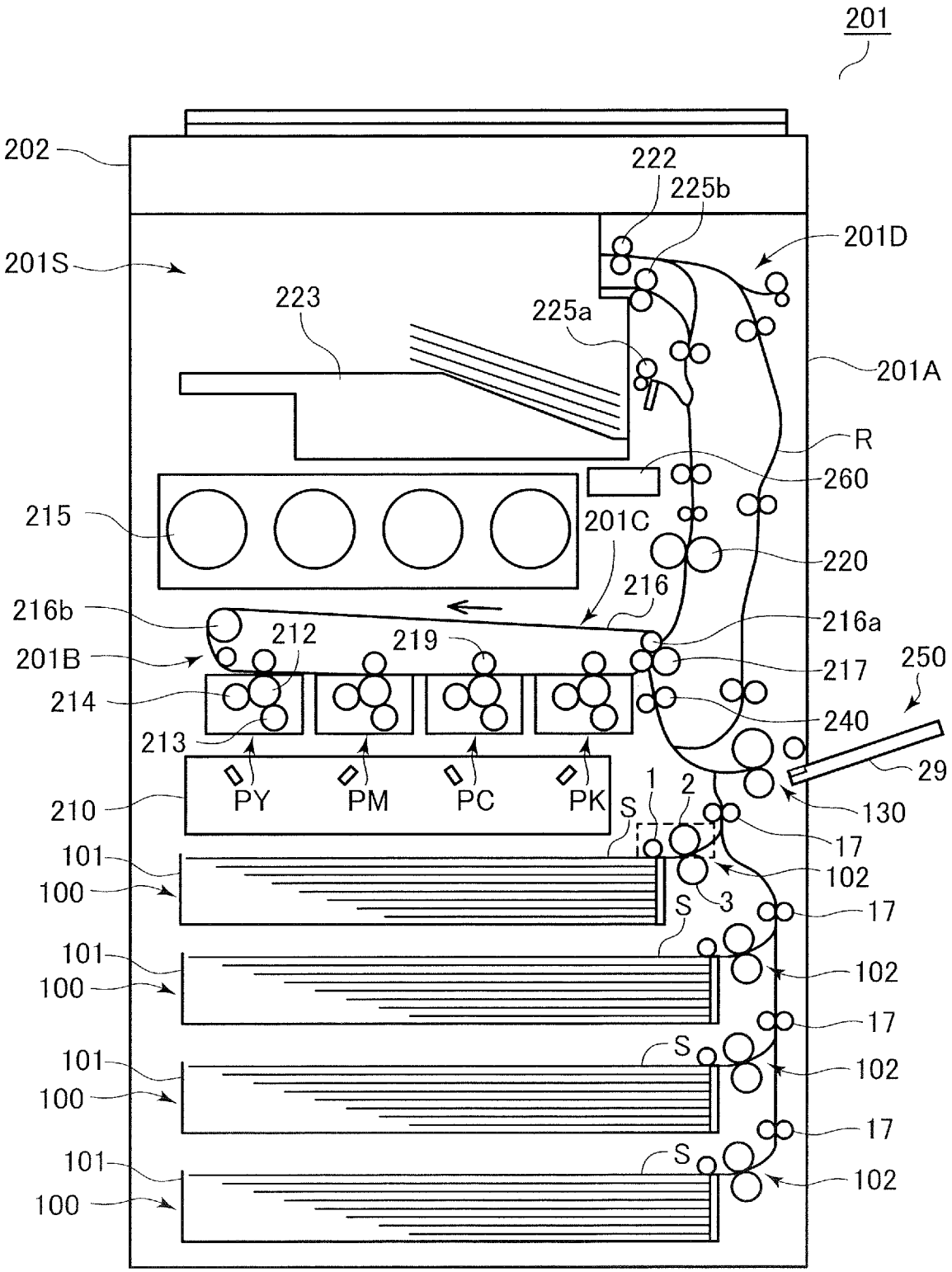
FIG. 1 is a schematic diagram of an image forming apparatus of the present disclosure.

As illustrated in FIG. 1, an image forming apparatus 201 of the present disclosure is a laser printer including an electrophotographic image forming portion 201B. Above a main body 201A (hereinafter referred to as an apparatus body) of the image forming apparatus, an image reading apparatus 202 is disposed substantially horizontally. In addition, a discharge space 201S used to discharge sheets is formed between the image reading apparatus 202 and the apparatus body 201A.

The image forming portion 201B of the present embodiment is a 4-drum full-color electrophotographic unit. That is, the image forming portion 201B includes a laser scanner 210 and four process cartridges PY, PM, PC, and PK which form four-color toner images of yellow (Y), magenta (M), cyan (C), and black (K). Each of the process cartridges PY to PK includes a photosensitive drum 212 which is a photosensitive member, a charger 213 which is a charging means, and a development unit 214 which is a developing means. The image forming portion 201B further includes an intermediate transfer unit 201C disposed above the process cartridges PY to PK, and a fixing portion 220. Above the intermediate transfer unit 201C, toner cartridges 215 are disposed to supply toner to the development units 214.

The intermediate transfer unit 201C includes an intermediate transfer belt 216 wound around a driving roller 216*a* and a tension roller 216*b*. Inside the intermediate transfer belt 216, primary transfer rollers 219 are disposed so as to abut against the intermediate transfer belt 216, each facing each photosensitive drum 212. The intermediate transfer belt 216 is rotated counterclockwise, in FIG. 1, by the driving roller 216*a* which is driven by a driving portion (not illustrated), and each toner image carried by the photosensitive drum 212 and having negative polarity is transferred onto the intermediate transfer belt 216, one on another, by the primary transfer rollers 219 in a sequential manner.

At a position facing the driving roller 216*a* of the intermediate transfer unit 201C, a secondary transfer roller 217 is disposed to transfer color images carried on the intermediate transfer belt 216 onto sheets S. The fixing portion 220 is disposed above the secondary transfer roller 217. Above the fixing portion 220, a first discharge roller pair 225*a*, a second discharge roller pair 225*b*, and a duplex reversing portion 201D are disposed. The duplex reversing portion 201D includes a reversing roller pair 222 which can rotate in a forward or reverse direction, and a re-conveyance path R. The re-conveyance path R is used to re-convey a sheet having an image on one side to the image forming portion 201B. The image forming apparatus 201 further includes a control portion 260 as a controller which controls the image forming operation and the sheet feeding operation.

Next, the image forming operation of the image forming apparatus 201 will be described. Image information of a document is read by the image reading apparatus 202, then image-processed by the control portion 260, then converted to an electrical signal, and then transmitted to the laser scanner 210 of the image forming portion 201B. In the image forming portion 201B, the surface of each photosensitive drum 212 is uniformly charged by the charger 213 so as to have a predetermined polarity and electric potential, and irradiated with a laser beam from the laser scanner 210, so that the surface of the photosensitive drum 212 is exposed by the laser beam while the photosensitive drum 212 is rotated. With this operation, an electrostatic latent image is formed on the surface of the photosensitive drum 212 of each of the process cartridges PY to PK. These electrostatic latent images correspond to monochrome images of yellow, magenta, cyan, and black. Each electrostatic latent image is developed and visualized by using a corresponding color of toner supplied from the development unit 214, and then primary-transferred from the photosensitive drum 212 onto the intermediate transfer belt 216, one on another, by a primary transfer bias applied to the primary transfer rollers 219.

In synchronization with such an operation, the sheets S are fed, one by one, from any one of a plurality of sheet feeding portions 100 or a manual sheet-feeding portion 250 toward a registration roller pair 240. The plurality of sheet feeding portions 100 are disposed in a bottom part of the apparatus body 201A, each including a cassette 101 and a feed unit 102. The cassette 101 is attached to the apparatus body 201A so that the cassette 101 can be drawn from the apparatus body 201A, and the feed unit 102 feeds the sheets S from the cassette 101. The feed unit 102 includes a pickup roller 1, a feed roller 2, and a separation roller 3. The pickup roller 1, which is a rotary pick-up member in this embodiment, rotates in contact with the top surface of the sheets S stored in the cassette 101, and thereby feeds the sheets S in a sheet feeding direction (right direction in FIG. 1). The feed roller 2, which is a rotary feed member in this embodiment, conveys the sheets S at a position downstream from the pickup roller 1 in the sheet feeding direction. The separation roller 3, which is a separation member in this embodiment, abuts against the feed roller 2; and serves as a separation portion to separate the sheets. A separation nip is formed between the separation roller 3 and the feed roller 2. The separation roller 3 applies a frictional force, exerted in a direction opposite to the sheet feeding direction, to another sheet entering the separation nip; and thereby separates the sheets S (uppermost sheet) in being conveyed by the feed roller 2, from the other sheet.

The sheet separated from the other sheet and conveyed, one by one, by the feed unit 102 is then conveyed upward via a conveyance roller pair 17, toward the registration roller pair 240. From the manual sheet-feeding portion 250 disposed on a side portion of the apparatus body 201A, another sheet set on a manual feed tray 29, which is another example of the sheet stacking portion, is fed by a feed unit 130 toward the registration roller pair 240.

The registration roller pair 240 corrects the skew of the sheet S, and then sends the sheet S toward the secondary transfer roller 217 in synchronization with the toner-image formation performed by the image forming portion 201B. At a transfer portion (i.e., secondary transfer portion) formed between the secondary transfer roller 217 and the intermediate transfer belt 216, full-color toner images are collectively secondary-transferred onto the sheet S by a secondary transfer bias applied to the secondary transfer roller 217. The sheet S onto which the toner images have been transferred is conveyed to the fixing portion 220. In the fixing portion 220, the toners having respective colors are melted and mixed with each other by heat and pressure, and the toner images are fixed on the sheet S as a color image.

Then the sheet S is stacked on a discharge portion 223 disposed on the bottom of the discharge space 201S, by a first discharge roller pair 225*a* or a second discharge roller pair 225*b* disposed downstream from the fixing portion 220. When images are to be formed on both sides of the sheet S, the sheet S having an image on a first side is reversed by the reversing roller pair 222, then conveyed to the re-conveyance path R, and then conveyed to the image forming portion 201B again. Then the sheet S, on a second surface of which an image has been formed by the image forming portion 201B, is discharged to the discharge portion 223 by the first discharge roller pair 225*a* or the second discharge roller pair 225*b*.

The above-described image forming portion 201B is one example of the image forming portion. Thus, the image forming portion may be a direct-transfer electrophotographic unit which directly transfers a toner image, formed on a photosensitive member, onto a sheet; or may be an ink-jet or offset-printing image forming portion.

Contact Pressure of Pickup Roller

The sheet feeding apparatus including the rotary pick-up member has the conveyance capability and the separation capability for sheets. Here, there will be described the relationship between the conveyance capability and the applying force of the rotary pick-up member applied to sheets, and the relationship between the separation capability and the applying force. In the following description, the applying force refers to a total load obtained by integrating a pressure, produced on a contact surface between objects, with an area of the contact surface.

Figure 7A:
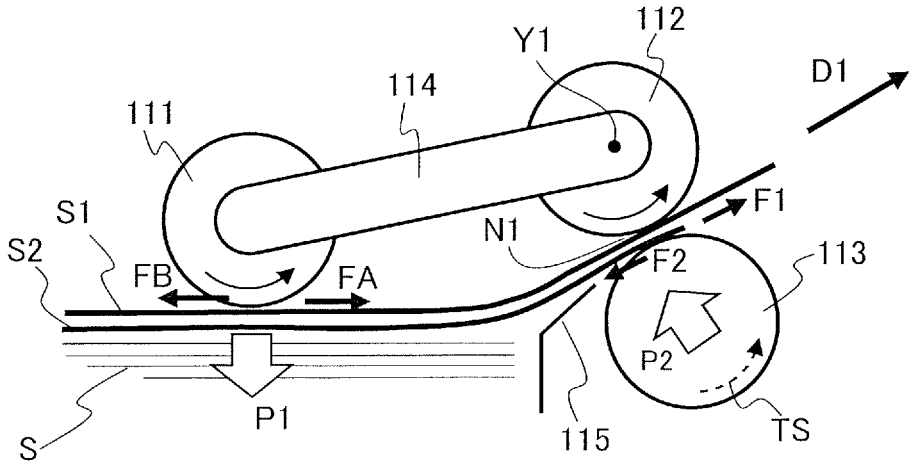
FIG. 7A is a schematic diagram for illustrating a conventional configuration.

As illustrated in FIG. 7A, in a known conventional configuration, a pickup roller 111 is held by a holding arm 114 which can swing on an axis Y1 (which is also a rotation axis of a feed roller 112 in this example) located downstream from the pickup roller 111 in a sheet feeding direction. A sheet S1 is an uppermost sheet of the sheets S stacked on a sheet stacking portion such as a cassette, and a sheet S2 is stacked under the sheet S1 (that is, the sheet S2 is the second one from the top). The pickup roller 111 abuts against the uppermost sheet S1 and rotates, and thereby delivers the sheet S1 toward a separation nip N1 formed between the feed roller 112 and a separation roller 113. In this operation, the sheet S1 is guided to the separation nip N1, along a feed guide 115. The separation roller 113 is in pressure contact with the feed roller 112, and receives a separation torque TS, via a torque limiter, exerted in a direction opposite to a feed direction D1 for the sheet S1.

After reaching the separation nip N1, the sheet S1 is conveyed in the feed direction D1 by the pickup roller 111 and the feed roller 112. Here, frictional force is produced on contact surfaces of the sheets S1 and S2, and causes a force F1 (multi-feeding force) by which the second sheet S2 is moved toward the feed direction D1. Thus, the sheet S2 may be taken out by the sheet S1 toward the feed direction D1. When the sheet S2 reaches the separation nip N1, the separation roller 113 exerts the separation torque TS on the sheet S2. The separation torque TS has a magnitude (i.e., value of transmission torque of a torque limiter) which allows the separation roller 113 to overcome the frictional force produced between the sheets and rotate in the direction opposite to the feed direction D1. As a result, the sheet S2 is normally pushed back toward the upstream side with respect to the separation nip N1, by the separation roller 113; and thus, only the sheet S1 is fed.

Here, a condition necessary to separate the sheet S2 at the separation nip N1 will be described. A force (separation force) F2 to separate the sheet S2 against the above-described multi-feeding force F1 is generally expressed as $F2=TS/r$, where r is a radius of the separation roller 113. When $F2>F1$, the sheet S2 is separated from the sheet S1. The multi-feeding force F1 is generally expressed as $F1=(P1+P2)\times\mu$, where $\mu$ is a coefficient of friction between the sheets S1 and S2. The variable P1 is an applying force of the pickup roller 111 to the sheet S1, and the variable P2 is an applying force of the separation roller 113 to the feed roller 112.

Since $F2>F1$ when the sheet S2 is separated, the separation capability for the sheet S2 is increased by increasing the separation force F2 or decreasing the multi-feeding force F1. In order to decrease the multi-feeding force F1, the applying force P1 of the pickup roller, the applying force P2 of the separation roller, or the coefficient of friction $\mu$ may be decreased. In practice, the applying force P1 of the pickup roller may be decreased to increase the separation capability for the sheet S2.

On the other hand, in order to stably convey the sheet S1, it is preferable that the applying force P1 of the pickup roller is large. For example, when a high-stiffness sheet, such as a piece of thick paper, is delivered and slides up on a slope of the feed guide 115, the sheet has a higher conveyance resistance than a low-stiffness sheet. In such a case, if force (i.e., conveyance force) applied by the pickup roller 111 to the sheet S1 in the feed direction is insufficient, the sheet S1 may not reach the separation nip, causing error of the feeding which is also known as conveyance failure.

The conveyance force FA of the pickup roller 111 is expressed as $FA=\mu A\times P1$, where $\mu A$ is a coefficient of friction between the pickup roller 111 and the sheet S1. Thus, the conveyance capability for sheets can be increased by increasing the applying force P1 of the pickup roller.

As can be seen, the applying force P1 of the pickup roller is preferably small to increase the separation capability for the sheet S2, but preferably large to increase the conveyance capability for the sheet S1. To satisfy such requirements, there is a known configuration in which a pickup roller is separated from a sheet by an actuator, such as a solenoid, in accordance with progress of the feeding. However, the actuator upsizes and complicates a corresponding apparatus.

Reference Example

Figure 7B:
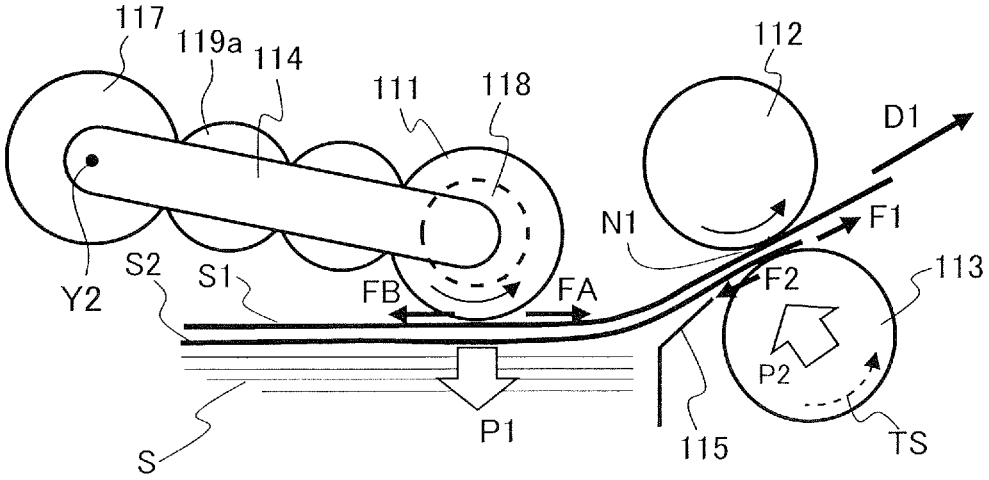
FIG. 7B is a schematic diagram for illustrating a configuration of the reference example.

As illustrated in FIG. 7B, a swing axis Y2 of the holding arm 114 holding the pickup roller 111 may be disposed upstream from a rotation axis of the pickup roller 111 in the feed direction D1. In this arrangement, when the pickup roller 111 delivers the sheet S1, a reaction force FB of the sheet S1 to the pickup roller 111 increases the applying force P1 of the pickup roller 111. That is, since the reaction force FB produces a moment which swings the holding arm 114 downward on the swing axis Y2 of the holding arm 114, the pickup roller 111 abuts against the sheet S1 more strongly. With the increased applying force P1 alone, however, although the conveyance capability for the sheet S1 increases, the sheet S2 is easily drawn and moved by the sheet S1, possibly causing multi-feeding of the sheets S1 and S2.

As a countermeasure, a one-way clutch 118 may be disposed, as illustrated in FIG. 7B, in a path through which the driving force for the pickup roller 111 is transmitted. In the configuration of this reference example, the one-way clutch 118 is disposed on the same axis as that of the rotation axis of the pickup roller 111, and a peripheral speed VA of the pickup roller 111 is set to be lower than a peripheral speed VB of the feed roller 112 ($VA<VB$).

With this configuration, when the sheet S1 reaches the separation nip N1, the sheet S1 is accelerated by the feed roller 112 having the higher peripheral speed than the pickup roller 111, causing the one-way clutch 118 to slip and the pickup roller 111 to run at idle. Thus, after the sheet S1 reaches the separation nip N1, the pickup roller 111 does not receive the reaction force FB from the sheet S1, and thus the increase in the applying force P1 of the pickup roller 111 caused by the reaction force FB is removed. As a result, the multi-feeding of the sheets S1 and S2 can be reduced to some extent, while the conveyance capability for the sheet S1 is improved.

However, even though the configuration of the above-described reference example is used, the multi-feeding of the sheets S1 and S2 may occur. Thus, there is desired a configuration which easily ensures the difference between the applying force of the pickup roller applied when the sheet S1 is sent toward the separation nip N1 (i.e., applying force in the pickup operation), and the applying force applied after the sheet S1 reaches the separation nip N1 (i.e., applying force in the separation-and-conveyance operation). This is because, if there is a sufficient difference between the applying forces, a high applying force can be used to increase the conveyance capability in the pickup operation, and a low applying force can be used to ensure the separation capability in the separation-and-conveyance operation, for highly reliably achieving both of increasing the conveyance capability and preventing the multi-feeding.

Detailed Description of Sheet Feeding Apparatus

In the present embodiment, the applying force of the pickup roller automatically changes because force is transmitted in different directions, in the pickup operation and the separation-and-conveyance operation. Hereinafter, a configuration of a sheet feeding apparatus of the present embodiment will be described with reference to FIGS. 2A to 6B.

Figure 2A:
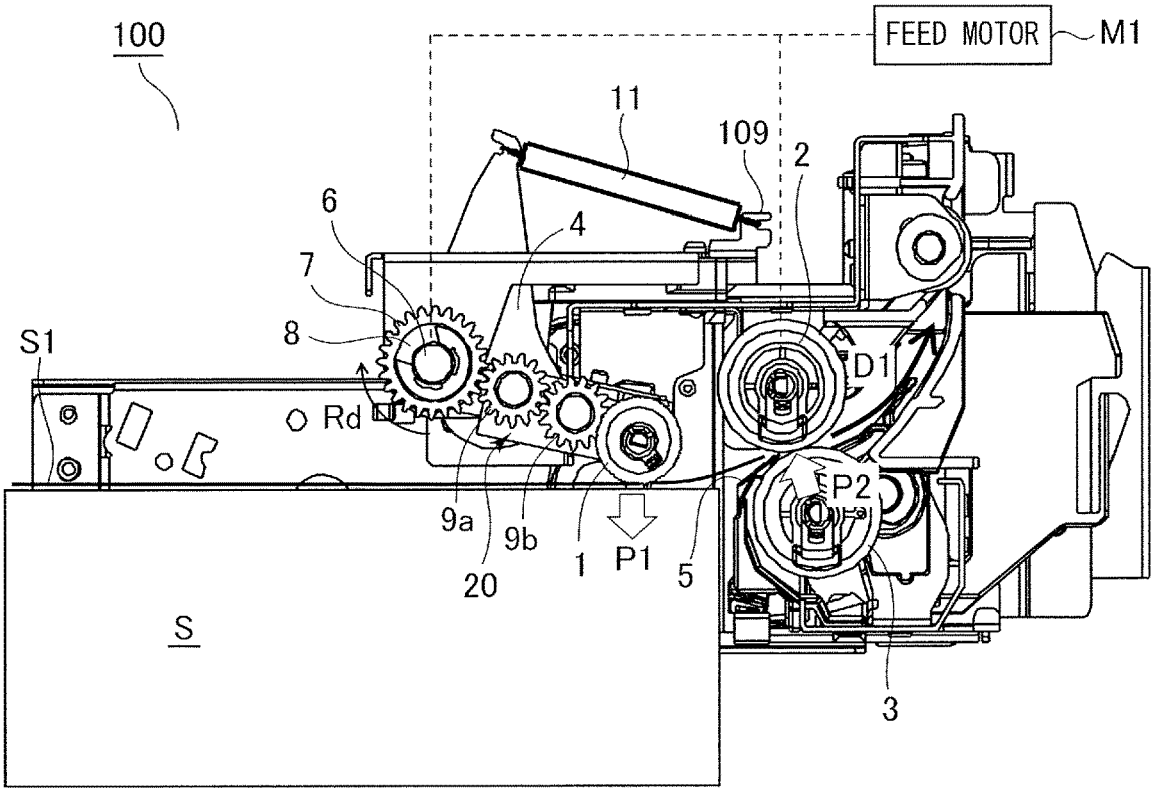
FIG. 2A is a schematic diagram of a sheet feeding apparatus.
Figure 2B:
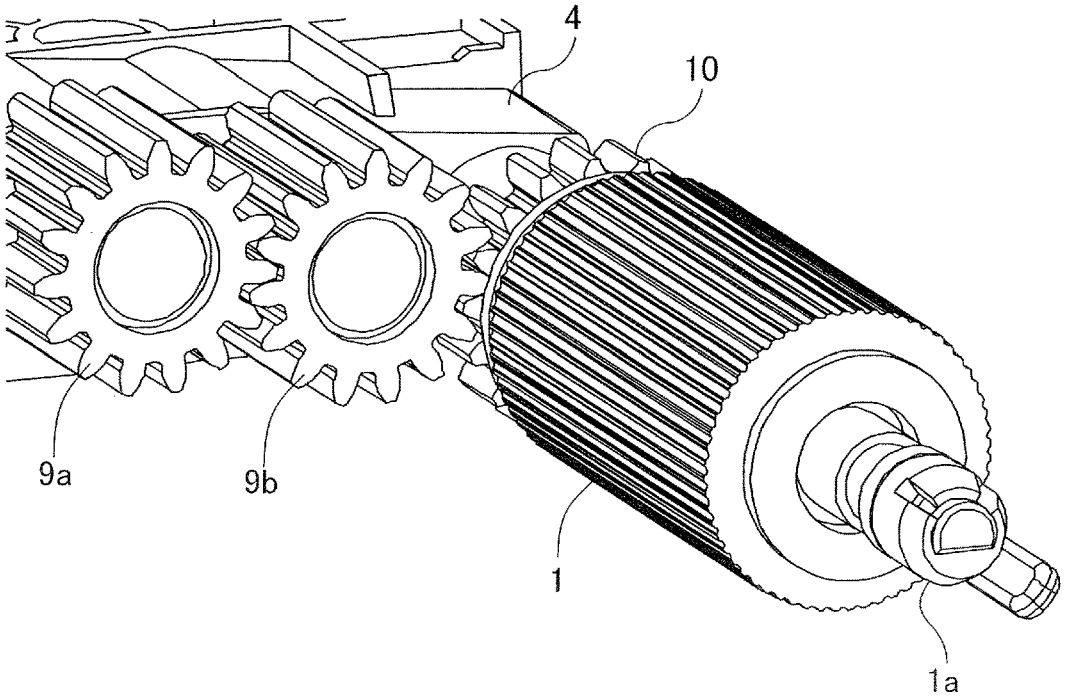
FIG. 2B is a perspective view of a pickup roller.

FIG. 2A is a schematic diagram illustrating a section of the sheet feeding portion 100, which is the sheet feeding apparatus of the present embodiment. FIG. 2B is a perspective view illustrating a periphery of the pickup roller 1. The sheet feeding portion 100 includes a feed unit 102 and a cassette 101 (see FIG. 1). The feed unit 102 includes the pickup roller 1, the feed roller 2, and the separation roller 3; the sheets S are stacked on the cassette 101. The pickup roller 1 is a rotary pick-up member, the feed roller 2 is a rotary feed member, and the separation roller 3 is a separation member.

The pickup roller 1 is rotatably supported by a roller shaft 1*a* (FIG. 2B) disposed in the holding arm 4. The holding arm 4, which serves as a holding member, can swing vertically, in FIG. 2A, on a swing axis identical to the axis of a drive shaft 6. The drive shaft 6 is a shaft member which transmits driving force to the pickup roller 1. The holding arm 4 is urged toward a direction in which the pickup roller 1 moves downward, by a spring member 11 disposed as an urging member so as to stretch between a frame 109 of the apparatus and the holding arm 4. Alternatively, the urging member may not be used, and instead, the pickup roller 1 may abut against the top surface of the sheets S due to the weight of the pickup roller 1, the holding arm 4, and the like.

A drive gear 7 is attached to the drive shaft 6 via a one-way clutch 8. The one-way clutch 8 transmits the rotation of the drive shaft 6, performed in a clockwise direction (Rd direction) in FIG. 2A, to the drive gear 7; and allows the drive gear 7 to rotate relative to the drive shaft 6 in the Rd direction. The drive shaft 6 is rotated by the driving force supplied from a feed motor M1. The drive gear 7 is a rotary driving member which is rotated around the swing axis of the holding member by the driving force from the driving source.

The holding arm 4 supports a gear train 20 which serves as a drive transmission portion used to transmit driving force from the drive gear 7 to the pickup roller 1 and vice versa (i.e., from the pickup roller 1 to the drive gear 7). The gear train 20 includes two idler gears 9*a* and 9*b*, and a roller driving gear 10 coupled with the pickup roller 1. In the configuration of the gear train 20, if the drive gear 7 is deemed as an input gear and the roller driving gear 10, which rotates with the pickup roller 1, is deemed as an output gear, the rotational direction of the input gear is opposite to the rotational direction of the output gear. That is, in the gear train, the rotation is transmitted via an even number of axes which are parallel with each other. For example, when the drive gear 7 rotates in the Rd direction, the pickup roller 1 rotates in a direction along with the feed direction D1, counterclockwise in FIG. 2A.

The feed roller 2 and the separation roller 3 are rotated by the feed motor M1. That is, both the pickup roller 1 and the feed roller 2 are driven by the feed motor M1, which is a single motor. The separation roller 3 is in pressure contact with the feed roller 2, with a predetermined applying force P2; and is supplied, via a torque limiter, with a driving force by the feed motor M1 in a direction opposite to the feed direction D1.

In the drive transmission path including the gear train 20 and coupled to the pickup roller 1 and the feed roller 2, when the feed motor M1 rotates, the peripheral speed V1 of the pickup roller 1, which corresponds to the driving speed of the drive shaft 6, is lower than the peripheral speed V2 of the feed roller 2. In other words, the peripheral speed V1 of the pickup roller 1 in a state where the drive shaft 6 rotates with the drive gear 7 without slipping of the one-way clutch 8 is lower than the peripheral speed V2 of the feed roller 2.

Figure 3A:
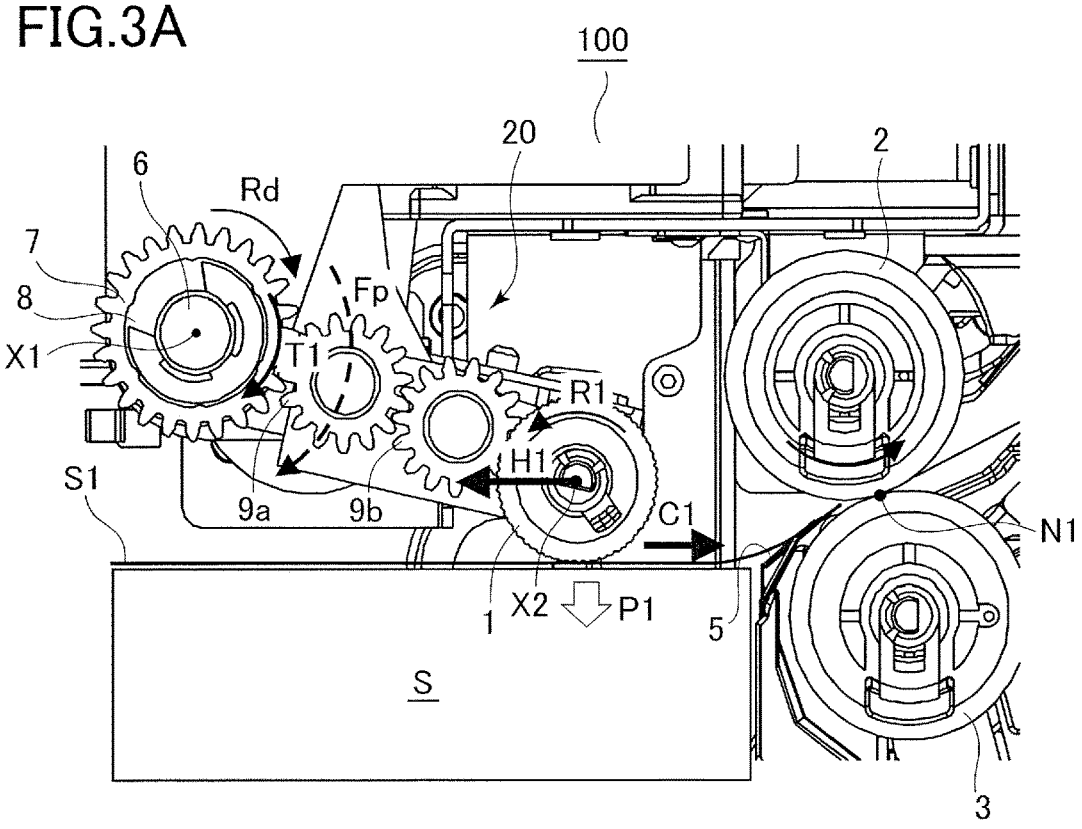
FIG. 3A is a schematic diagram illustrating a pickup operation.
Figure 3B:
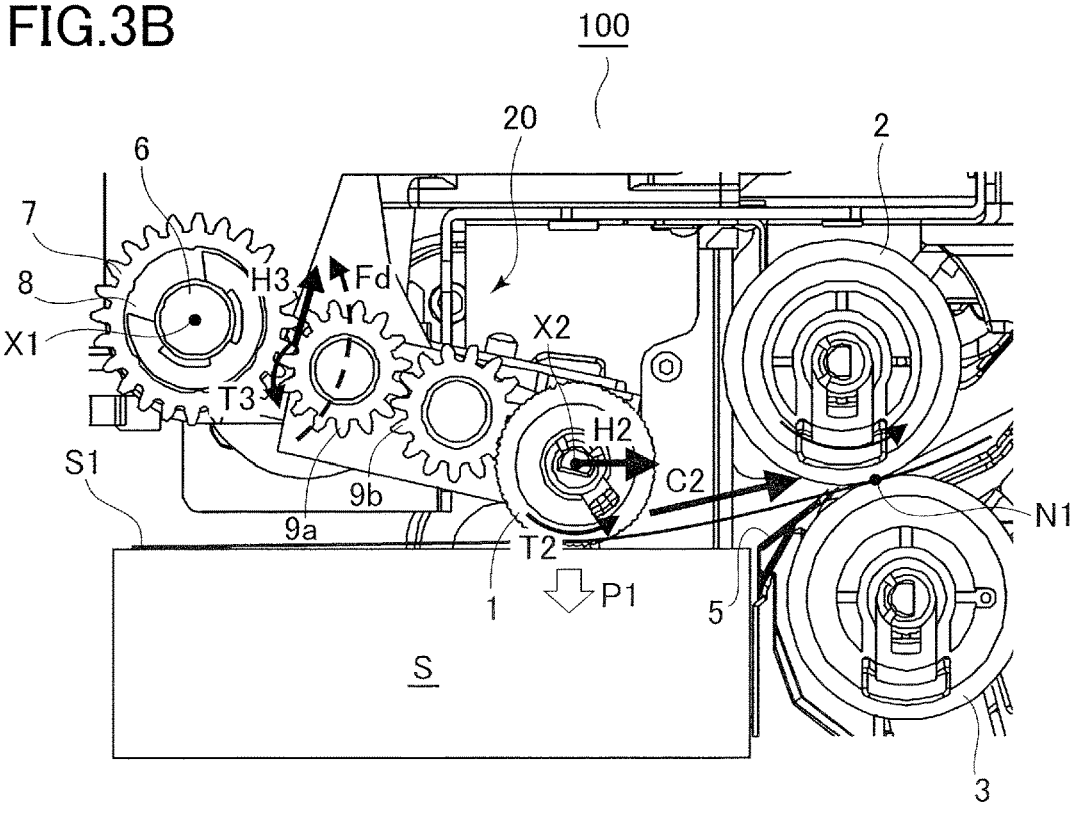
FIG. 3B is a schematic diagram illustrating a separation-and-conveyance operation.

The feeding operation for the uppermost sheet S1 will be described with reference to FIGS. 3A and 3B. FIG. 3A illustrates a state of the feeding operation observed before the leading edge of a sheet (downstream edge of a sheet in the feed direction) reaches the separation nip N1 (i.e., a state of the pickup operation). FIG. 3B illustrates a state of the feeding operation observed after the leading edge of the sheet has reached the separation nip N1 (i.e., a state of the separation-and-conveyance operation).

As illustrated in FIG. 3A, when the feeding operation for the sheet S1 is started, the drive shaft 6 rotates in the Rd direction, and the drive gear 7 is rotated in the Rd direction, via the one-way clutch 8. Then the driving force is transmitted to the pickup roller 1 via the gear train 20, and the pickup roller 1 is rotated in the counterclockwise direction (R1 direction) in FIG. 3A. With this operation, the uppermost sheet S1 is sent toward the separation nip N1. The leading edge of the sheet S1 moves along the guide surface of the feed guide 5, which is sloped with respect to the top surface of the sheets S which have been set in the cassette. As illustrated in FIG. 3B, when the leading edge of the sheet S1 reaches the separation nip N1, the sheet S1 is further conveyed downstream in the feed direction, by the conveyance force applied from the feed roller 2. In this operation, if a plurality of sheets enter the separation nip N1, sheets other than the uppermost sheet S1 are pushed back to the upstream side in the feed direction by the frictional force from the separation roller 3. Thus, only the sheet S1 is fed.

In the configuration of the present embodiment, when the sheet S1 is fed in this manner, the applying force P1 of the pickup roller 1 is dynamically changed by the force applied to the pickup roller 1 from the sheet S1, and the force exerted by the driving force transmitted via the gear train 20. The change in the applying force will be described for a case where the leading edge of the sheet S1 is moving in a section in which the sheet S1 has not reached the separation portion, and for a case where the leading edge of the sheet S1 is moving in a section in which the sheet S1 has already reached the separation portion.

Section in which Leading Edge of Sheet has not Reached Separation Portion

Hereinafter, the description will be made with reference to FIG. 3A. In a state where the leading edge of the sheet S1 has not reached the separation nip N1, the applying force P1 of the pickup roller is changed by the following two factors. Here, the change of the applying force P1 is determined with respect to a contact pressure between the pickup roller 1 and the sheet S1 in a state where the pickup roller 1 is not rotated. In addition, in a case where the sheets stacked on a stacking plate of the cassette 101 move up and down with the stacking plate, the change of the applying force P1 is determined with respect to a contact pressure between the pickup roller 1 and the sheet S1 in a state where the stacking plate has moved up to a position at which the feeding operation is started. In the present embodiment, a reference (i.e., initial load) of the applying force P1 is defined by the urging force of the spring member 11 (see FIG. 2A).

1. Force Applied to Pickup Roller from Sheet (Conveyance Reaction Force of Sheet)

In a state where the leading edge of the sheet has not reached the separation nip N1, the pickup roller 1 is rotated in an R1 direction at the peripheral speed V1, and the sheet S1 is moved in the feed direction by a conveyance force C1 applied by the pickup roller 1. The pickup roller 1 receives a conveyance reaction force H1 in a direction opposite to the feed direction from the sheet S1, as a reaction force to the conveyance force C1. Here, since a swing axis X1 of the holding arm 4 is positioned upward and upstream from a rotation axis X2 of the pickup roller 1 in the feed direction, the conveyance reaction force H1 produces a moment which swings the holding arm 4 clockwise, in FIG. 3A, on the swing axis X1.

2. Driving Force Transmitted from Gear to Gear (Output Torque of Drive Gear)

In the state where the leading edge of the sheet has not reached the separation nip N1, the drive gear 7 rotates with the drive shaft 6 via the one-way clutch 8, and the rotation of the drive gear 7 is transmitted to the pickup roller 1 via the gear train 20. In this case, the drive gear 7 rotating in the Rd direction, in FIG. 3A, exerts an output torque T1 on the idler gear 9*a* supported by the holding arm 4; and the output torque T1 produces a moment which urges the holding arm 4 to swing clockwise, in FIG. 3A, on the swing axis X1.

Thus, both the conveyance reaction force H1 and the output torque T1 of the drive gear 7 produce a moment Fp which urges the holding arm 4 to swing clockwise, in FIG. 3A, on the swing axis X1. The moment Fp is exerted in the rotational direction Rd (first rotational direction), in which the pickup roller 1 moves downward around the swing axis X1. Thus, the moment Fp increases the applying force P1 of the pickup roller 1. In other words, the first rotational direction is a rotation direction in which the downstream side of the drive gear 7 in the feed direction D1 with respect to the swing axis X1 moves downward and the upstream side of the drive gear 7 with respect to the swing axis X1 moves upward.

In addition, the conveyance reaction force H1 and the output torque T1 of the drive gear 7 increase as the conveyance resistance increases. For example, when the feed motor M1 is controlled so that the pickup roller 1 rotates at a predetermined peripheral speed V1, the load of the motor increases as the conveyance resistance increases. As a result, the output torque of the motor increases. Thus, when a sheet having a large conveyance resistance, such as a piece of thick paper, is conveyed, the conveyance reaction force H1 and the output torque T1 of the drive gear 7 increase, increasing the moment Fp and the applying force P1 of the pickup roller. In contrast, when a sheet having a small conveyance resistance, such as a piece of thin paper, is conveyed, the conveyance reaction force H1 and the output torque T1 of the drive gear 7 have relatively smaller values, causing the applying force P1 of the pickup roller to become smaller than those obtained when a sheet having a large conveyance resistance is conveyed.

Section in which Leading Edge of Sheet has Already Reached Separation Portion

Hereinafter, the description will be made with reference to FIG. 3B. In a state where the leading edge of the sheet S1 has already reached the separation nip N1, the applying force P1 of the pickup roller is changed by the following two factors.

1. Force Applied to Pickup Roller from Sheet (Force with which Sheet Pulls Pickup Roller)

As previously described, the peripheral speed V2 of the feed roller 2 is higher than the peripheral speed V1 of the pickup roller 1. Thus, when the sheet S1 reaches the separation nip N1, the sheet S1 is accelerated up to V2 or a speed close to V2. As a result, the pickup roller 1 is rotated not by the driving force transmitted from the drive gear 7, but being dragged by the sheet S1. That is, a pulling force C2 that the sheet S1 pulls the pickup roller 1 produces a torque T2 which rotates the pickup roller 1.

The transmission path, including the gear train 20 and the drive gear 7, from the pickup roller 1 to the one-way clutch 8 has frictional resistance. Thus, when the sheet S1 in contact with the pickup roller 1 is pulled by the pulling force C2, having a value equal to or larger than a certain value, toward the feed direction, the pickup roller 1 is rotated against the frictional resistance. Here, the swing axis X1 of the holding arm 4 is positioned upstream from the rotation axis X2 of the pickup roller 1 in the feed direction, and upward from the rotation axis X2. As a result, a force H2 applied to the holding arm 4 by the pulling force C2 produces a moment which swings the holding arm 4 counterclockwise, in FIG. 3B, on the swing axis X1.

2. Force Produced by Gear Engagement (Rotational Resistance of Drive Gear)

As described above, when the torque T2 applied to the pickup roller 1 from the sheet S1 is transmitted to the drive gear 7 via the gear train 20, the one-way clutch 8 slips and causes the drive gear 7 to run at idle. Here, the drive gear 7 runs at idle, not freely regardless of load, but requiring a torque having a value equal to or larger than a certain value. Thus, when the pickup roller 1 is rotated 1*a* being pulled by the sheet S1, a torque T3 is transmitted from the idler gear 9*a* to the drive gear 7, and thereby the drive gear 7 is rotated against frictional resistance of the one-way clutch 8.

In this case, the idler gear 9*a*, which serves as a rotary intermediate member to transmit the rotation of the pickup roller 1 to the drive gear 7, receives a reaction force H3 produced due to the rotational resistance of the drive gear 7. The reaction force H3 is applied upward, and has a magnitude corresponding to the torque T3. The reaction force H3 which the idler gear 9*a*, supported by the holding arm 4, receives from the drive gear 7 produces a moment which urges the holding arm 4 to swing counterclockwise, in FIG. 3B, on the swing axis X1. In this operation, the drive gear 7 rotates clockwise in FIG. 3B. However, since the drive gear 7 is supported not by the holding arm 4 but by the drive shaft 6, the torque T3 which the drive gear 7 receives does not produce the moment that urges the holding arm 4 to swing on the swing axis X1. In addition, the torque is transmitted through engagement surfaces between the idler gears 9*a* and 9*b*, and between the idler gear 9*b* and the roller driving gear 10. As to the moment around the swing axis X1, however, forces which adjacent gears exert on each other are canceled in all the engagement surfaces. Eventually, when the torque T3 is transmitted from the pickup roller 1 to the drive gear 7 via the gear train 20, the moment produced due to the reaction force H3 is exerted on the holding arm 4.

That is, the force H2 produced when the sheet S1 pulls the pickup roller 1 and the reaction force H3 produced due to the rotational resistance of the drive gear 7 both produce a moment Fd which urges the holding arm 4 to swing counterclockwise, in FIG. 3B, on the swing axis X1. The moment Fd is exerted in a rotational direction (second rotational direction) in which the pickup roller 1 swings upward around the swing axis X1. Thus, the moment Fd decreases the applying force P1 of the pickup roller 1.

As described above, in the present embodiment, the swing axis X1 of the holding arm 4 holding the pickup roller 1 is disposed upstream from the rotation axis X2 of the pickup roller 1 in the sheet feeding direction. In addition, the direction in which the force is transmitted by the drive transmission portion (in this embodiment, the gear train 20) before the leading edge of the sheet reaches the separation portion is opposite to the direction in which the force is transmitted by the drive transmission portion after the leading edge of the sheet reaches the separation portion. That is, before the leading edge of the sheet reaches the separation nip N1, the pickup roller 1 is rotated by the driving force of the drive gear 7; after the leading edge of the sheet reaches the separation nip N1, the drive gear 7 is rotated by the rotation of the pickup roller 1.

With this configuration, in a section in which the leading edge of the sheet has not reached the separation portion, the conveyance reaction force H1 from the sheet and the output torque T1 of the drive gear 7 both produce the moment Fp in the first rotational direction, and the moment Fp urges the pickup roller 1 downward. This moment Fp increases the applying force P1 of the pickup roller 1, and improves the conveyance capability for the sheet S1. In particular, the moment Fp automatically changes in accordance with the conveyance resistance of the sheet S1, and thus the applying force P1 of the pickup roller 1 increases as the conveyance resistance increases. Thus, even when the sheet S1 has a large conveyance resistance, or the conveyance resistance of the sheet S1 increases when the sheet S1 slides on the feed guide 5, the sheet S1 can be stably conveyed.

On the other hand, in a section in which the leading edge of the sheet has already reached the separation portion, the force H2 with which the sheet pulls the pickup roller 1 and the force H3 which the gear train 20 receives from the drive gear 7 both produce the moment Fd in the second rotational direction, and the moment Fd urges the pickup roller 1 upward. This moment Fd decreases the applying force P1 of the pickup roller, reducing the multi-feeding force exerted on a sheet stacked under the sheet S1 to be fed. Thus, the occurrence of multi-feeding is reduced.

That is, in the present embodiment, the applying force P1 of the pickup roller 1 can be changed significantly before and after the leading edge of the sheet reaches the separation nip. This can ensure the conveyance capability by increasing the applying force P1 in the pickup operation, and ensure the separation-and-conveyance operation by decreasing the applying force P1 in the separation-and-conveyance operation.

Results of Experiments

Figure 4:
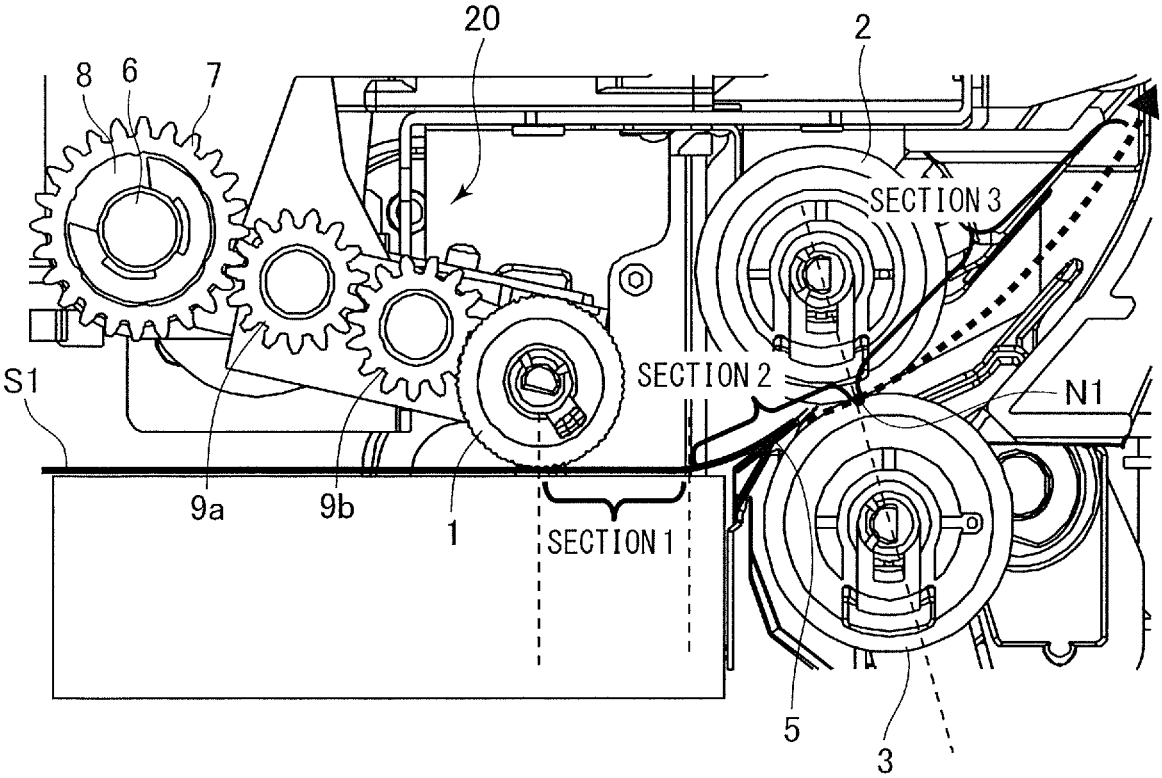
FIG. 4 is a schematic diagram for illustrating sections of a sheet conveyance path.
Figure 5:
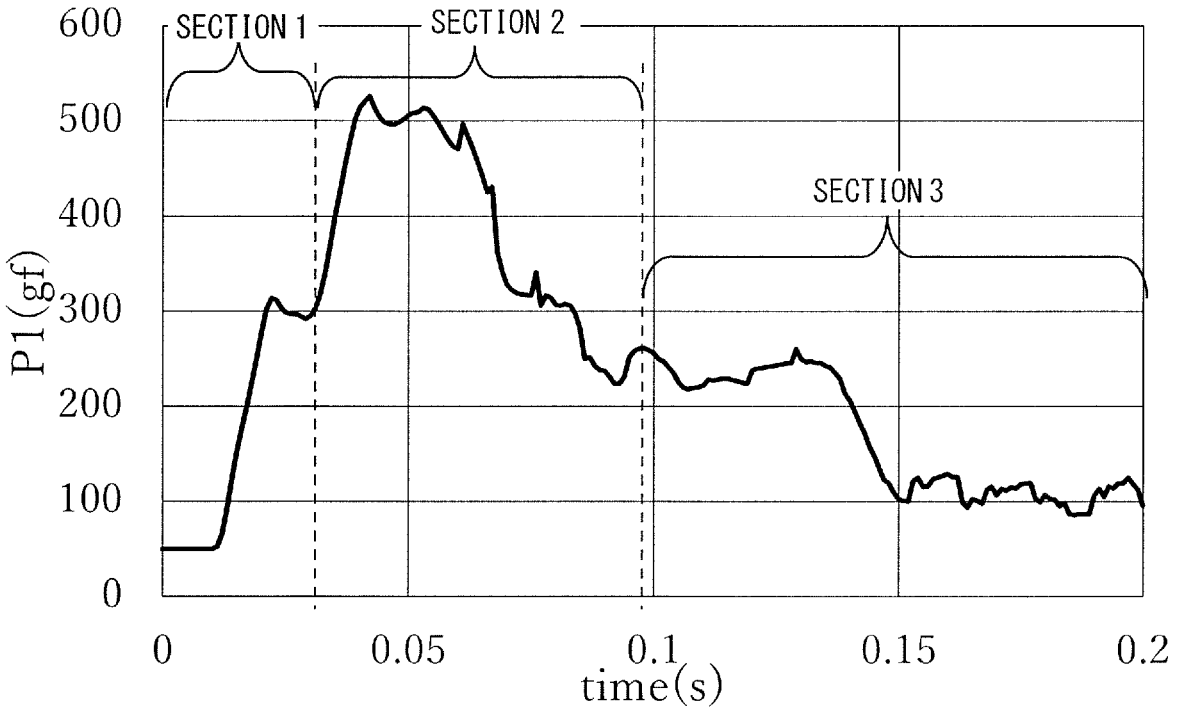
FIG. 5 is a graph indicating a measurement result on applying force of the pickup roller of the sheet feeding apparatus to which the present embodiment has been applied.
Figure 6A:
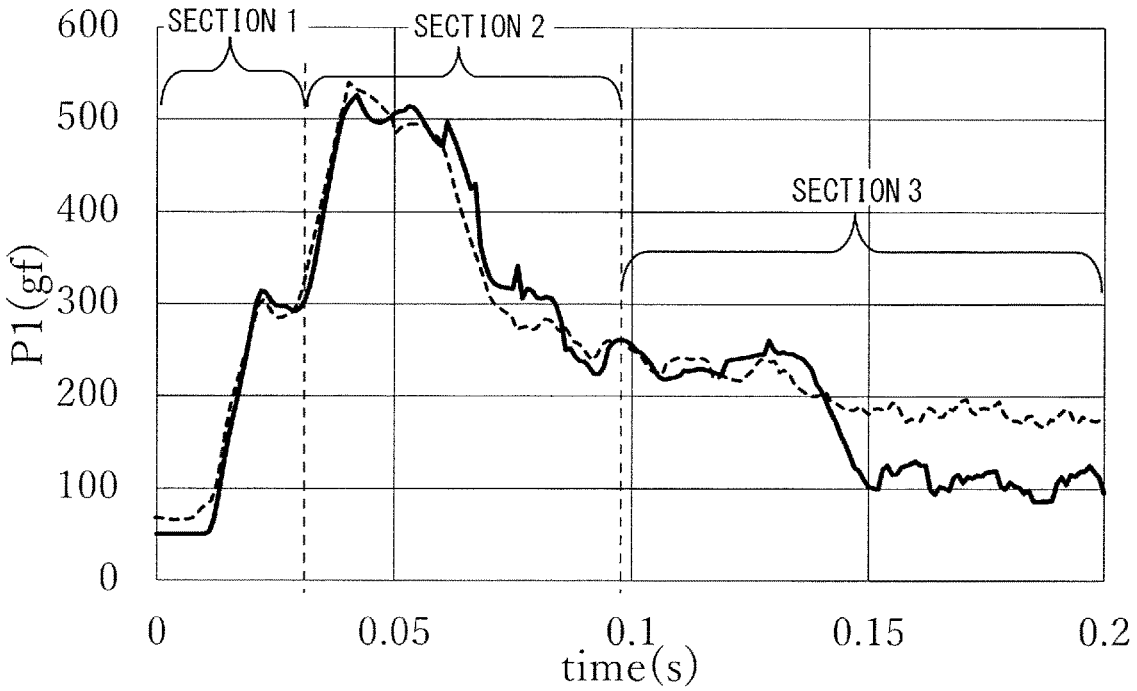
FIG. 6A is a graph indicating a measurement result on applying force of the pickup roller of the present embodiment, and a measurement result on applying force of a pickup roller of a reference example.
Figure 6B:
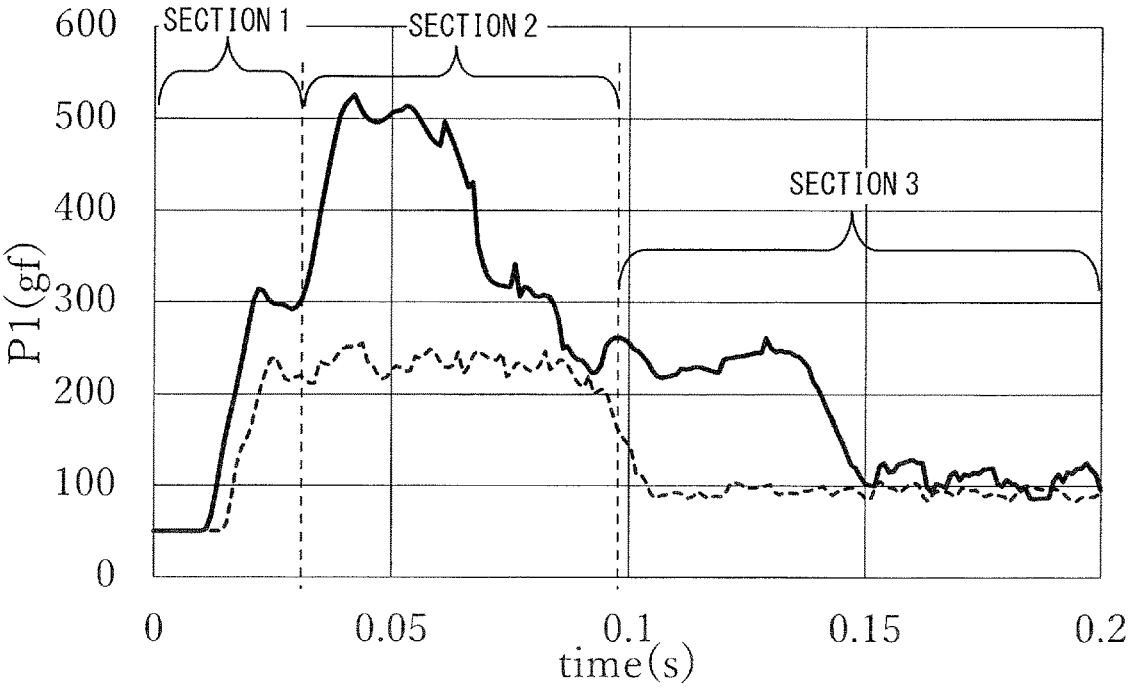
FIG. 6B is a graph indicating a measurement result on applying force of the pickup roller of the present embodiment, obtained when either a piece of thick paper or a piece of thin paper was conveyed.

Results of experiments conducted by using a sheet feeding apparatus of the present embodiment will be described. The measurement results on the applying force P1 of the pickup roller, illustrated in FIGS. 5, 6A, and 6B, are indicated, with the sheet conveyance path divided into three sections, as illustrated in FIG. 4, to study the relationship between the position of the leading edge of the sheet and the applying force P1. As illustrated in FIG. 4, Section 1 is a conveyance section on the upstream side with respect to the feed guide 5 in the feed direction, Section 2 is a conveyance section from the upstream edge of the feed guide 5 to the separation nip N1, and Section 3 is a conveyance section on the downstream side with respect to the separation nip N1.

An initial value (initial load) of the applying force P1 of the pickup roller used for the experiments was 50 gf (gram-forces). The applying force P1 of the pickup roller may be measured by using a measuring instrument whose pressure sensor is disposed at a position facing the pickup roller, with the sheet, which is being conveyed, held by the pickup roller and the pressure sensor.

FIG. 5 is a graph indicating measurement values of the applying force P1 of the pickup roller, obtained when the sheet was conveyed by using the sheet feeding apparatus of the present embodiment. Each of indications "SECTION 1" to "SECTION 3" indicates that the sheet S1 is passing a corresponding section.

The graph indicates that the applying force P1 of the pickup roller 1 increases in Section 1 and Section 2. This is because the moment Fp, which urges the pickup roller 1 downward, is exerted on the holding arm 4 when the pickup roller 1 is rotated by the drive gear 7, as described above. Specifically, when the pickup roller 1 starts to rotate in Section 1, the moment Fp is exerted on the holding arm 4 by the conveyance reaction force H1 applied to the pickup roller 1 and the output torque T1 of the drive gear 7, and thus the applying force P1 is increased. With the increased applying force P1, the sheet S1 is stably sent for the separation nip N1.

In Section 2, when the leading edge of the sheet slides up on the slope of the feed guide 5, the conveyance resistance of the sheet S1 is added with a slide resistance of the sheet S1 to the guide surface of the feed guide 5, and with a resistance caused when the leading edge of the sheet enters the separation nip N1. As described above, since the moment Fp exerted on the holding arm 4 changes in accordance with the conveyance resistance, the maximum value of the applying force P1 increases more in Section 2, than that in Section 1. This is because the conveyance resistance increases more in Section 2, than that in Section 1. In this example, while the sheet S1 passed through Section 2, the applying force P1 increased from the initial load of 50 gf to a value larger than 500 gf. Thus, since the applying force P1 increases significantly in this manner, the sheet S1 more reliably reaches the separation nip N1.

When the leading edge of the sheet reaches Section 3, the applying force P1 decreases because the resistance, caused when the sheet S1 enters the separation portion, is removed. As can be seen, since the conveyance speed of the sheet is increased by the conveyance force applied to the sheet from the feed roller 2, the applying force P1 decreases, finally down to a value close to the initial load (50 gf). This is because, when the sheet S1 is conveyed finally at the peripheral speed V2 of the feed roller 2, the applying force P1 is decreased, as described above, by the force H2 with which the sheet S1 pulls the pickup roller 1, and by the reaction force H3 which the gear train 20 receives from the drive gear 7. Thus, the lowered applying force P1 reduces the possibility of multi-feeding of a sheet stacked under the sheet S1.

In the graph of FIG. 5, the applying force P1 of the pickup roller is kept at about 250 gf for about 40 ms (milliseconds) after the leading edge of the sheet reaches Section 3. This is because, when the sheet S1 contacts the feed roller 2 rotating at the peripheral speed V2, the speed of the sheet S1 does not immediately become V2 because of the resistance of the feed guide 5, inertia of the sheet S1, and the like. Thus, even though the sheet is normally fed, the applying force P1 decreases with a time delay since the leading edge of the sheet has passed the separation nip N1.

In addition, in a case where the sheet has an extremely large conveyance resistance, such as a case where the sheet is a piece of extremely thick paper (like a cardboard or a board), the feed roller 2 may slip due to the conveyance resistance after the leading edge of the sheet passes through the separation nip N1. This causes the conveyance speed to be lower than the peripheral speed V1 of the pickup roller 1. In this example, however, since the drive shaft 6 is continuously driven at a driving speed corresponding to the peripheral speed V1 even after the leading edge of the sheet reaches the separation nip N1, the sheet is given the conveyance force by the pickup roller 1 when an actual peripheral speed of the pickup roller 1 (conveyance speed of the sheet) becomes lower than the designated peripheral speed V1. In this case, as described for Section 1 and Section 2, the applying force P1 increases in accordance with the conveyance resistance, and thus the pickup roller 1 assists the conveyance of sheets performed by the feed roller 2.

That is, even when the leading edge of the sheet is being conveyed in Section 3, the applying force P1 of the pickup roller 1 automatically changes in accordance with a conveyance condition (e.g., conveyance speed) of the sheet S1. With this operation, reducing multi-feeding of sheets and improving stability of the conveyance operation are both achieved.

Comparison with Reference Example

Here, the difference from the above-described reference example (see FIG. 7B) will be described. In the present embodiment, the one-way clutch 8 is disposed on the swing axis X1 of the holding arm 4; but in the above-described reference example, the one-way clutch 118 is disposed on the rotation axis of the pickup roller 111.

FIG. 6A is a graph indicating a measurement result (indicated by a solid line and identical to the measurement result of FIG. 5) on the applying force P1 of the pickup roller of the example of the present embodiment, and a measurement result (indicated by a broken line) on the applying force of the pickup roller of the reference example. As described above, in the present embodiment, the applying force P1 significantly decreases in Section 3. This is because the force with which the sheet pulls the pickup roller 1 and the reaction force that the gear train 20 receives from the drive gear 7 are produced in accordance with the increase of the sheet conveyance speed in Section 3, and the forces produce the moment which swings the holding arm 4 upward.

In contrast, in the reference example (indicated by the broken line), the applying force P1 does not decrease in Section 3 in which the leading edge of the sheet has already passed the separation nip N1, and is kept at a value which is substantially the same as that obtained immediately after the leading edge of the sheet passes through the separation nip N1. That is, the reference example may not sufficiently reduce the possibility of multi-feeding of sheets, compared to the present embodiment.

This is because, in the reference example, the force with which the sheet pulls the pickup roller 111 and the reaction force that the gear train receives from the drive gear 117 are hardly produced. Specifically, since the one-way clutch 118 is disposed on the same axis as that of the pickup roller 111, the moment exerted on the holding arm 114 becomes extremely small even though the conveyance speed of the sheet is increased and thereby the one-way clutch 118 slips. That is, the reference example causes the pickup roller 111 to run at idle with a small force, compared to the present embodiment in which, when the pickup roller 1 runs at idle, the frictional resistance occurs in the drive transmission components (such as the idler gears 9*a* and 9*b*) disposed between the pickup roller 1 and the drive gear 7. As a result, in the reference example, the force (H2 of FIG. 3B) with which the accelerated sheet pulls the pickup roller 111 hardly reduces the applying force P1.

In addition, in the reference example, since the one-way clutch 118 is disposed on the same axis as that of the pickup roller 111, the rotation of the pickup roller 111 is not transmitted to the drive gear 117 disposed on the swing axis Y2 of the holding arm 114. That is, unlike the present embodiment in which the drive gear 7 is forced to run at idle by the idler gear 9*a* after the leading edge of the sheet reaches the separation nip N1, the reference example does not cause a gear 119*a* engaged with the drive gear 117 to rotate the drive gear 117. As a result, unlike the present embodiment, the reaction force (H3 of FIG. 3B) produced when the drive gear 117 is rotated is not produced, not reducing the applying force P1. Thus, the reference example does not sufficiently reduce the applying force P1 of the pickup roller after the leading edge of the sheet passes through the separation nip N1.

Automatic Adjustment of Applying Force in Accordance with Conveyance Resistance

FIG. 6B illustrates a result of a measurement conducted to evaluate a function of automatically adjusting the applying force of the pickup roller in accordance with the conveyance resistance. The solid line is the same as that of the graph of FIG. 5, and indicates a measurement result on the applying force P1 obtained when a piece of thick paper having a relatively high stiffness was fed. The broken line indicates a measurement result of the applying force P1 obtained when a piece of thin paper having a relatively low stiffness was fed.

When a piece of thin paper having a low stiffness is fed, the conveyance resistance of the sheet hardly increases even when the leading edge of the sheet slides up on the feed guide 5. As a result, as illustrated in FIG. 6B, the applying force P1 of the pickup roller 1 in Section 1 and Section 2, obtained when a piece of thin paper was fed, was smaller than that obtained when the piece of thick paper was fed. In particular, the applying force P1 hardly increased in Section 2; and the maximum value of the applying force P1 for the piece of thick paper (solid line) exceeded 500 gf, whereas the maximum value of the applying force P1 for the piece of thin paper (broken line) was about 270 gf. Thus, it is understood that pieces of thick paper can be stably sent by using a high applying force, and that pieces of thin paper can be sent by using a low applying force, which can reduce the occurrence of multi-feeding.

In Section 3, the applying force P1 for the piece of thin paper finally had the same value (about 100 gf) as that for the piece of thick paper, but immediately decreased when the leading edge of the sheet entered Section 3. In contrast, the applying force P1 for the piece of thick paper was kept at a relatively high value for about 40 ms because the moving speed of the sheet changes with a time lag, as described above. Thus, it is understood that the applying force P1 for pieces of thin paper quickly decreases to reduce the occurrence of multi-feeding, and that, when pieces of thick paper (i.e., the sheet S1 having a high conveyance resistance) are conveyed, the pickup roller 1 assists the conveyance of the sheet S1 performed by the feed roller 2.

Modified Examples

In the above-described embodiment, the pickup roller 1 and the feed roller 2 are driven by the shared driving source (feed motor M1), and gear ratios are set so that the peripheral speed V1 of the pickup roller 1 becomes lower than the peripheral speed V2 of the feed roller 2. However, two motors corresponding to the pickup roller 1 and the feed roller 2 may be provided to produce the difference between the peripheral speeds. Alternatively, another clutch such as an electromagnetic clutch may be provided to cut off the driving force to be transmitted to the drive gear 7, when the leading edge of the sheet reaches the separation portion.

These modifications are applicable as long as, after the leading edge of the sheet reaches the separation portion, the pickup roller 1 is rotated by pulling the sheet, and the drive gear 7 is rotated at a rotational speed faster than a driving speed (including zero) produced by the feed motor M1. This is because, when the drive gear 7 is rotated at the rotational speed faster than the driving speed produced by the feed motor M1, the applying force of the pickup roller 1 is reduced by the reaction force that the gear train 20 receives from the drive gear 7, regardless of the presence of the one-way clutch 8. However, in the viewpoint of reducing wear of the pickup roller 1, the one-way clutch 8 is preferably disposed to allow the pickup roller 1 to relatively freely rotate, as in the present embodiment.

In addition, although the gear train 20 constituted by the four gears (7, 9*a*, 9*b*, and 10) is used as the drive transmission portion in the present embodiment, another drive transmission portion may be used. For example, the drive gear 7 may directly mesh with the roller driving gear 10. Alternatively, a belt-driven transmission mechanism may be used. In this case, a driving pulley may be disposed instead of the drive gear 7, a driven pulley coupled with the driving pulley via a transmission belt may be disposed instead of the idler gears 9*a* and 9*b*, and a gear disposed on the same axis as that of the driven pulley may mesh with the roller driving gear 10. In short, any configuration is applicable as long as, when the rotary driving member rotates in the Rd direction of FIG. 2A, the pickup roller 1 rotates in the feed direction D1.

In addition, although the above description has been made for the case where the pickup roller 1 is a rotary pick-up member which delivers sheets stacked on the sheet stacking portion, and the feed roller 2 is a rotary feed member which is located downstream from the rotary pick-up member to feed the sheets, a belt member may be used instead of the pickup roller 1 and the feed roller 2. In addition, the separation roller 3, which receives the driving force applied in the direction opposite to the sheet feeding direction, is one example of separation members. Thus, another member such as a roller member or a pad member may be used instead of the separation roller 3. In this case, the roller member may be attached, via a torque limiter, to a shaft which is fixed to the apparatus body; and the pad member may face the feed roller 2.

In addition, although the present embodiment has been described for the sheet feeding apparatus, which is included in the apparatus body 201A of the image forming apparatus 201 to feed sheets to the image forming portion 201B, this technique may be used for other sheet feeding apparatuses. For example, this technique may be used for the manual sheet-feeding portion 250, or a sheet feeding apparatus of the image reading apparatus 202 which feeds document sheets.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-220443, filed on Nov. 15, 2017, which is hereby incorporated by reference herein in its entirety.

What is claimed is:

1. A sheet feeding apparatus comprising:

a sheet stacking portion on which a sheet is stacked;

a pick-up roller configured to rotate, in contact with a top surface of the sheet stacked on the sheet stacking portion, and deliver the sheet in a sheet feeding direction;

a feed roller disposed downstream of the pick-up roller in the sheet feeding direction and configured to convey the sheet;

a motor configured to drive both the pick-up roller and the feed roller;

a separation member disposed in contact with the feed roller and configured to separate the sheet conveyed by the feed roller from another sheet at a separation nip formed between the separation member and the feed roller;

a feed guide configured to guide the sheet being delivered by the pick-up roller;

a rotation shaft on which the pick-up roller is rotatably supported;

a drive shaft disposed upstream of the rotation shaft in the sheet feeding direction and configured to transmit a driving force of the motor to the pick-up roller;

a holding arm holding the rotation shaft and configured to swing around the drive shaft;

a drive gear configured to rotate on the drive shaft;

a one-way clutch attached to the drive shaft to connect the drive shaft and the drive gear and configured to transmit rotation in a first rotational direction of the drive shaft to the drive gear and to allow the drive gear to rotate in the first rotational direction relative to the drive shaft; and a gear train supported by the holding arm and interconnecting the drive gear and the pick-up roller, wherein in a state where the motor drives both the pick-up roller and the feed roller without slipping of the one-way clutch, a peripheral speed of the pick-up roller is lower than a peripheral speed of the feed roller, wherein the one-way clutch is configured such that (i) in delivering the sheet stacked on the sheet stacking portion toward the separation nip, rotation of the drive shaft in a first rotational direction is transmitted through the one-way clutch, the drive gear and the gear train to rotate the pick-up roller without slipping of the one-way clutch, and (ii) after a leading edge of the sheet in the sheet feeding direction has reached the separation nip, the pick-up roller is dragged and rotated by the sheet conveyed by the feed roller, rotation of the pick-up roller is transmitted through the gear train to the drive gear, and the drive gear is rotated in the first rotational direction with respect to the drive shaft that is rotated in the first rotational direction while the one-way clutch is slipping, wherein the holding arm is configured to be applied a moment around the drive shaft in a second rotational direction opposite to the first rotational direction in a state where the pick-up roller is dragged by the sheet conveyed by the feed roller, so that a pressing force of the pick-up roller pressing the sheet after the leading edge of the sheet in the sheet feeding direction has reached the separation nip is smaller than the pressing force of the pick-up roller in delivering the sheet stacked on the sheet stacking portion toward the separation nip while the leading edge of the sheet is guided by the feed guide.

2. The sheet feeding apparatus according to claim 1, wherein the gear train is disposed so that in delivering the sheet stacked on the sheet stacking portion toward the separation nip, the drive gear rotating in the first rotational direction rotates the gear train such that a moment in the first rotational direction is exerted on the holding arm, and after the leading edge of the sheet has reached the separation nip, the gear train rotates the drive gear in the first rotational direction while receiving a reaction force from the drive gear such that the moment in the second rotational direction is exerted on the holding arm.

3. The sheet feeding apparatus according to claim 1, wherein the separation member is a separation roller disposed in contact with the feed roller.

4. The sheet feeding apparatus according to claim 1, wherein the gear train comprises an even number of idler gears interconnecting the drive gear on the drive shaft and the pick-up roller on the rotation shaft.

5. The sheet feeding apparatus according to claim 1, wherein in a state where the sheet is conveyed by the feed roller, the drive shaft is driven by the motor while drive transmission from the drive shaft to the pick-up roller is stopped by slipping of the one-way clutch.

6. The sheet feeding apparatus according to claim 1, further comprising an urging member disposed between the holding arm and a frame of the sheet feeding apparatus and configured to urge the holding arm in the first rotational direction around the drive shaft and defining an initial value of the pressing force of the pick-up roller.

7. An image forming apparatus comprising:

a sheet feeding apparatus configured to feed a sheet; and an image forming portion configured to form an image on a sheet fed by the sheet feeding apparatus, wherein the sheet feeding apparatus comprises:

a sheet stacking portion on which a sheet is stacked;

a pick-up roller configured to rotate, in contact with a top surface of the sheet stacked on the sheet stacking portion, and deliver the sheet in a sheet feeding direction;

a feed roller disposed downstream of the pick-up roller in the sheet feeding direction and configured to convey the sheet;

a motor configured to drive both the pick-up roller and the feed roller;

a separation member disposed in contact with the feed roller and configured to separate the sheet conveyed by the feed roller from another sheet at a separation nip formed between the separation member and the feed roller;

a feed guide configured to guide the sheet being delivered by the pick-up roller;

a rotation shaft on which the pick-up roller is rotatably supported;

a drive shaft disposed upstream of the rotation shaft in the sheet feeding direction and configured to transmit a driving force of the motor to the pick-up roller;

a holding arm holding the rotation shaft and configured to swing around the drive shaft;

a drive gear configured to rotate on the drive shaft;

a one-way clutch attached to the drive shaft to connect the drive shaft and the drive gear and configured to transmit rotation in a first rotational direction of the drive shaft to the drive gear and to allow the drive gear to rotate in the first rotational direction relative to the drive shaft; and a gear train supported by the holding arm and interconnecting the drive gear and the pick-up roller, wherein in a state where the motor drives both the pick-up roller and the feed roller without slipping of the one-way clutch, a peripheral speed of the pick-up roller is lower than a peripheral speed of the feed roller, wherein the one-way clutch is configured such that (i) in delivering the sheet stacked on the sheet stacking portion toward the separation nip, rotation of the drive shaft in a first rotational direction is transmitted through the one-way clutch, the drive gear and the gear train to rotate the pick-up roller without slipping of the one-way clutch, and (ii) after a leading edge of the sheet in the sheet feeding direction has reached the separation nip, the pick-up roller is dragged and rotated by the sheet conveyed by the feed roller, rotation of the pick-up roller is transmitted through the gear train to the drive gear, and the drive gear is rotated in the first rotational direction with respect to the drive shaft that is rotated in the first rotational direction while the one-way clutch is slipping, wherein the holding arm is configured to be applied a moment around the drive shaft in a state where the pick-up roller is dragged by the sheet conveyed by the feed roller, so that a pressing force of the pick-up roller pressing the sheet after the leading edge of the sheet in the sheet feeding direction has reached the separation nip is smaller than the pressing force of the pick-up roller in delivering the sheet stacked on the sheet stacking portion toward the separation nip while the leading edge of the sheet is guided by the feed guide.

* * * * *